US006912990B2

(12) United States Patent
Parche

(10) Patent No.: US 6,912,990 B2
(45) Date of Patent: Jul. 5, 2005

(54) FUEL INJECTION SYSTEM FOR AN INTERNAL COMBUSTION ENGINE

(75) Inventor: Marcus Parche, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/432,382

(22) PCT Filed: Jul. 13, 2002

(86) PCT No.: PCT/DE02/02575

§ 371 (c)(1),
(2), (4) Date: Nov. 19, 2003

(87) PCT Pub. No.: WO03/027490

PCT Pub. Date: Apr. 3, 2003

(65) Prior Publication Data

US 2004/0069276 A1 Apr. 15, 2004

(30) Foreign Application Priority Data

Sep. 22, 2001 (DE) ..... 101 46 745

(51) Int. Cl.[7] ..... F02B 3/00
(52) U.S. Cl. ..... 123/299; 123/467
(58) Field of Search ..... 123/299, 305, 123/467, 506, 514, 501; 239/88, 89

(56) References Cited

U.S. PATENT DOCUMENTS 5,984,201 A 11/1999 Hofmann et al.
6,491,017 B1 * 12/2002 Mahr et al. ..... 123/299
6,725,840 B1 * 4/2004 Mahr et al. ..... 123/467
6,796,290 B2 * 9/2004 Boehland et al. ..... 123/446

FOREIGN PATENT DOCUMENTS

GB 2 086 473 A 5/1982
WO WO 01/69076 A 9/2001

* cited by examiner

*Primary Examiner*—Mahmoud Gimie
(74) *Attorney, Agent, or Firm*—Ronald E. Greigg

(57) ABSTRACT

The fuel injection system has a fuel injection valve acted upon by the pressure prevailing in a pressure chamber of the fuel injection valve and is movable by this pressure, counter to the force of a closing spring, in an opening direction to open the at least one injection opening, and fuel is delivered under high pressure to the pressure chamber by a high-pressure fuel pump for a fuel injection. The injection valve member is urged in the closing direction at least indirectly by a variable pressure prevailing in a spring chamber of the fuel injection valve. The spring chamber has a communication with a pressure source, which is controlled by a valve whereby different opening pressures of the fuel injection valve for a preinjection and a main injection of fuel can be attained.

21 Claims, 6 Drawing Sheets

FUEL INJECTION SYSTEM FOR AN INTERNAL COMBUSTION ENGINE

CROSS-REFERENCE TO RELATED APPLICATIONS

This application is a 35 USC 371 application of PCT/DE 02/02575 filed on Jul. 13, 2002.

BACKGROUND OF THE INVENTION

1. Field of the Invention

The invention is directed to an improved fuel injection system for an internal combustion engine.

2. Description of the Prior Art

One such fuel injection system, known from German Patent Disclosure DE 42 11 651 A1, has a fuel injection valve with an injection valve member, by which at least one injection opening is controlled. The injection valve member is acted upon by the pressure prevailing in a pressure chamber of the fuel injection valve and is movable by it, counter to the force of a closing spring, in an opening direction to open the at least one injection opening. Fuel is delivered under high pressure to the pressure chamber for the fuel injection. The opening pressure of the fuel injection valve, in other words the pressure in the pressure chamber, at which the pressure force acting on the injection valve member Is greater than the force of the closing spring acting on the injection valve member, and at which the injection valve member moves in the opening direction to open the at least one injection opening, is dependent only on the prestressing of the closing spring and is thus fixedly specified. To adapt the fuel injection optimally to various operating states of the engine, and to adapt the course of the fuel injection for the sake of achieving the lowest possible emissions of exhaust gas and noise, however, the opening pressure of the fuel injection valve should be variable.

SUMMARY OF THE INVENTION

The fuel injection system of the invention has the advantage over the prior art that by means of the variable pressure in the spring chamber, the opening pressure of the fuel injection valve can be varied, making it possible to adapt to various operating states of the engine and/or to a predetermined course of the fuel injection.

Advantegeous features and refinements of the fuel injection system of the invention are disclosed. One embodiment enables a variation in the force acting on the injection valve member in the closing direction by means of the pressure operative in the spring chamber, by varying the cross-sectional area effectively acted upon by it. A further embodiment makes it possible to damp the motion of the injection valve member in its opening direction. while another makes a fuel injection possible at low pressure during a preinjection, so that a small fuel quantity with little combustion noise is attained, and a fuel injection during a main injection at high pressure, thus achieving good atomization of the fuel. Another variation enables the pressure in the control chamber and thus the opening pressure of the fuel injection valve are controlled in a simple way. The pump work chamber can advantageously serve as the pressure source for the control chamber, so that no additional expense is required for that purpose, the control chamber may be provided with a relief. A simple variation of the pressure in the control chamber is made possible by relieving it with the pressure valve closed, or for the pressure furnished by the pressure source to prevail in it when the pressure valve is open.

BRIEF DESCRIPTION OF THE DRAWINGS

The foregoing and other features and advantages will become apparent from the detailed description contained herein below, taken in conjunction with the drawings, in which.

DESCRIPTION OF THE PREFERRED EMBODIMENTS

Figure 1:
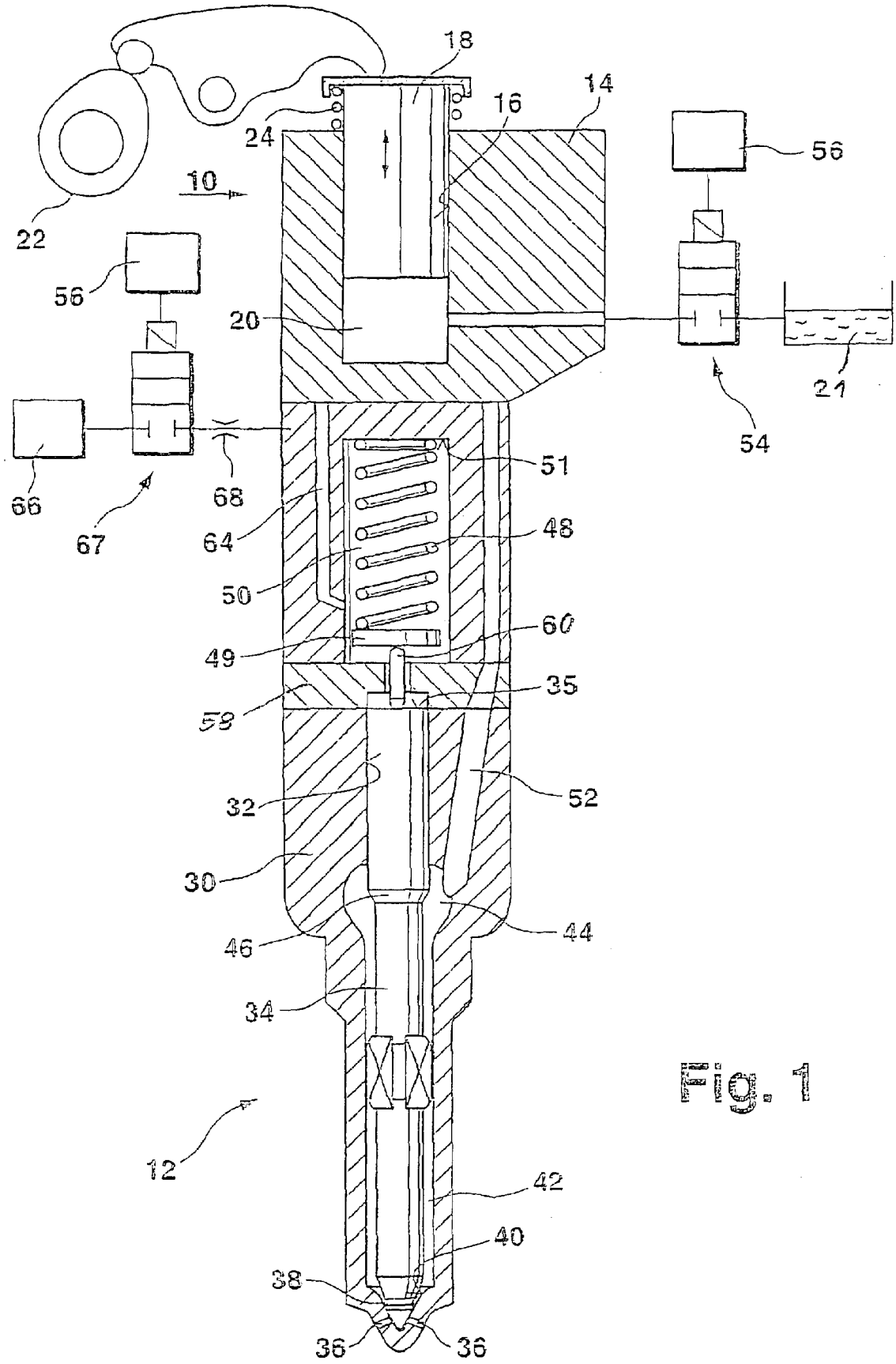
FIG. 1 is a simplified illustration, in section, of a fuel injection system embodying the invention for use in an internal combustion engine.

In FIGS. 1–6 and 8–12, a fuel injection system for an internal combustion engine, for instance of a motor vehicle, is shown. The engine is a self-igniting internal combustion engine and has one or more cylinders. In the exemplary embodiment shown in FIG. 1, the fuel injection system is embodied as a unit fuel injector, and for each cylinder of the engine, it has one high-pressure fuel pump 10 and one fuel injection valve 12, which form a common structural unit. In a departure from this, however, it can also be provided that the high-pressure fuel pump and the fuel injection valve 12 are disposed separately from one another and communicate with one another via a line. It can also be provided that one common high-pressure fuel pump is provided for all the cylinders of the engine, while each cylinder is provided with its own fuel injection valve 12.

The high-pressure fuel pump 10 has a pump body 14, in which a pump piston 18 is guided sealingly displaceably in a cylinder bore 16 and defines a pump work chamber 20 in the cylinder bore 16. The pump piston 18 is driven in a reciprocating motion by a cam 22 of a camshaft of the engine, counter to the force of a restoring spring 24.

The fuel injection valve 12 has a valve body 30, which may be embodied in multiple parts and which is connected to the pump body 14. In the valve body 30, there is a bore 32 in which an injection valve member 34 is guided longitudinally displaceably. The valve body 30, in its end region toward the combustion chamber of the cylinder of the engine, has at least one and preferably a plurality of injection openings 36. The injection valve member 34, in its end region toward the combustion chamber, has a sealing face 38, which for instance is approximately conical and which cooperates with a valve seat 40, embodied in the valve body 30 in its end region toward the combustion chamber; the injection openings 36 lead away from or downstream of this valve seat. In the valve body 30, between the injection valve member 34 and the bore 32, toward the valve seat 40, there is an annular chamber 42, which in its end region remote from the valve seat 40 changes over, by means of a radial widening of the bore 32, into a pressure chamber 44 that surrounds the injection valve member 34. At the level of the pressure chamber 44, the injection valve member 34 has a pressure shoulder 46, created by a cross-sectional reduction. The end of the injection valve member 34 remote from the combustion chamber is engaged at least indirectly by a prestressed closing spring 48, by which the injection valve member 34 is pressed toward the valve seat 40. The closing spring 48 is disposed in a spring chamber 50 of the valve body 30 that adjoins the bore 32. The injection valve member 34 is braced at least indirectly on a spring plate 49 disposed in the spring chamber 50 and resting on the closing spring 48. A conduit 52 is embodied in the pump body 14 and in the valve body 30, and through it the pressure chamber 44 communicates with the pump work chamber 20. It can also be provided that the injection valve member 34 is braced on the closing spring 48 via a separate piston.

The pump work chamber 20 has a communication with a low-pressure region, for instance at least indirectly with a fuel tank 21, which is controlled by an electrically controlled valve 54. The valve 54 may be embodied as a magnet valve or may have a piezoelectric actuator and is triggered by an electronic control unit 56. In an intake stroke of the pump piston 18, the valve 54 is opened, so that fuel from the fuel tank 21 can reach the pump work chamber 20. In the pumping stroke of the pump piston 18, the valve 54 is closed by the control unit 56, at an instant at which a fuel injection is to begin. The length of time for which the valve 54 remains closed determines the quantity of fuel that is injected.

The fuel injection system is shown in FIG. 1 in a first exemplary embodiment. The bore 32, in which the injection valve member 34 is guided, is disconnected from the spring chamber 50 by a partition 58, which has an opening 59, for instance in the form of a bore, whose cross section is smaller than that of the bore 32. A peg 60 passes through the bore 59 in the partition 58 and rests on one end on the face end 35 of the injection valve member 34 toward the partition 58 and on the other on the face end of the spring plate 49 toward the partition 58. The peg 60 can be embodied either separately from or integrally with the injection valve member 34 and has a smaller cross section than the injection valve member 34. In the spring chamber 50, or in at least in a portion of the spring chamber 50 in which the closing spring 48 is disposed between the spring plate 49 and the bottom 51 of the spring chamber 50, a variable pressure is set, which reinforces the force of the closing spring 48 by acting at least indirectly on the injection valve member 34. The setting of the variable pressure in the spring chamber 50 will be described in further detail below.

In the first exemplary embodiment of FIG. 1, the spring plate 49 is disposed with great radial play in the spring chamber 50, so that on its face end toward the closing spring 48 and on its face end toward the partition 58, it is acted upon by the pressure prevailing in the spring chamber 50. The peg 60 passes with great radial play through the bore 59 in the partition 58. The chamber 61 defined in the bore 32 by the face end 35 of the injection valve member 34 toward the partition 58 thus communicates with the spring chamber 50 because of the great radial play between the peg 60 and the bore 59. Thus effectively an area corresponding to the total cross-sectional area of the injection valve member 34 in the bore 32 is acted upon by the pressure prevailing in the spring chamber 50.

Figure 2:
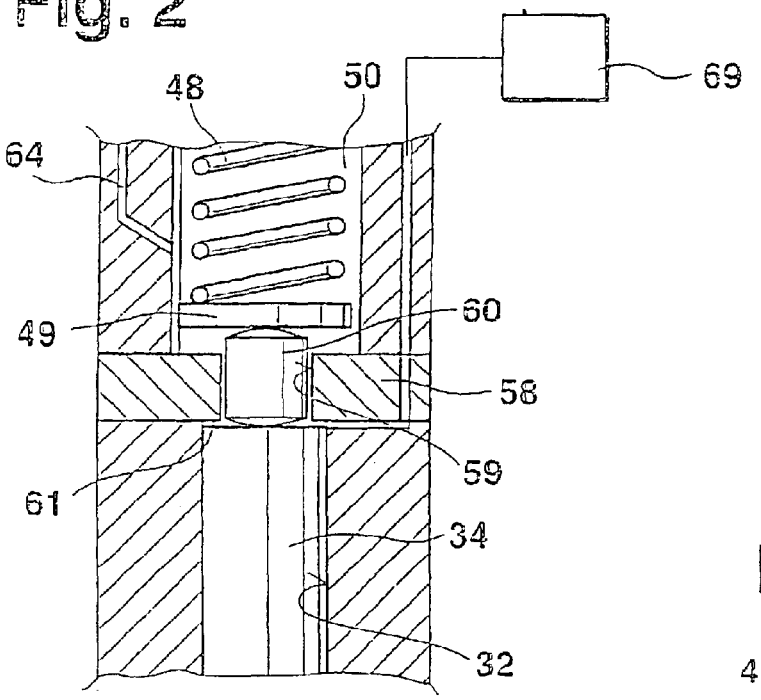
FIGS. 2–6 are details showing various modifications of the exemplary embodiments of the fuel injection system of FIG. 1.

In FIG. 2, the fuel injection system is shown in a detail of a second exemplary embodiment, in which in a departure from the first exemplary embodiment the peg 60 passes through the bore 59 in the partition 58 with slight radial play. Thus the chamber 61 in the bore 32 is disconnected from the spring chamber 50, and the chamber 61 communicates with a low-pressure region 69, so that when the injection valve member 34 moves, fuel can flow in and out.

Thus effectively only an area corresponding to the cross-sectional area of the peg 60 is acted upon by the pressure prevailing in the spring chamber 50.

Figure 3:
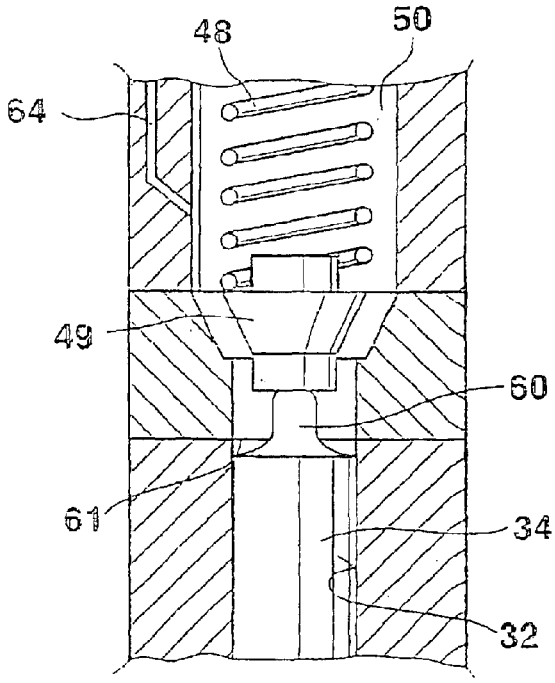

In FIG. 3, the fuel injection system is shown in a detail of a third exemplary embodiment, in which the partition 58 between the bore 32 and the spring chamber 50 is omitted. The spring chamber 50 has a greater cross section than the bore 32 in which the injection valve member 34 is guided. The transition from the bore 32 to the spring chamber 50 is embodied approximately conically, for instance. The spring plate 49 is disposed in the region of the transition and is likewise embodied approximately conically. The injection valve member 34 rests on the spring plate 49 via the peg 60. Thus the pressure prevailing in the spring chamber 50 also prevails in the bore 32 and effectively acts on an area corresponding to the cross-sectional area of the injection valve member 34 in the bore 32.

Figure 4:
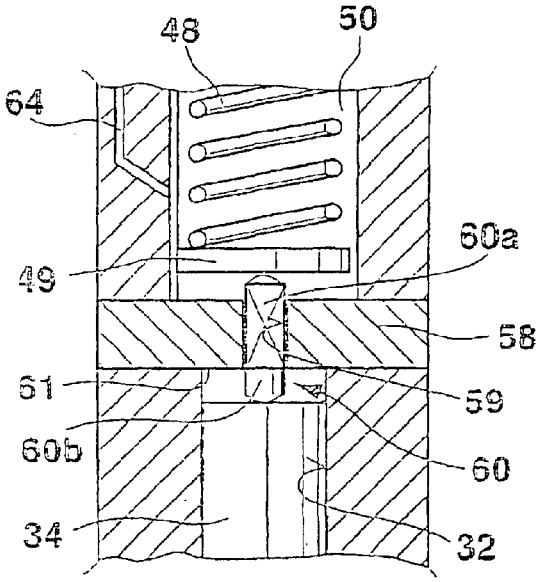

In FIG. 4, the fuel injection system is shown in a detail of a fourth exemplary embodiment, which essentially corresponds to the second exemplary embodiment except that the embodiment of the peg 60 is modified. The peg 60 passes with slight radial play through the bore 59 and over its length has two regions 60*a, b* with cross sections of different sizes. The region 60*a* of the peg 60, which is disposed toward the spring plate 49, has a smaller cross section than the region 60*b* of the peg 60, which is disposed toward the injection valve member 34. By way of example, the peg 60 can be embodied circular-cylindrically, and the region 60*a* of smaller cross section is formed by providing at least one flat face on the circumference of the peg 60. It is also possible for two, three or more flat faces to be provided. As in the second exemplary embodiment, only the cross-sectional area of the peg 60 is effectively acted upon by the pressure in the spring chamber 50. When the injection valve member 34 is in its closing position, in which it rests with its sealing face 38 on the valve seat 40, the region 60*a* of the peg 60 is disposed in the bore 59, so that a gap remains between the peg 60 and the bore 59, through which gap the chamber 61 in the bore 32 communicates with the spring chamber 50, and through which fuel can flow out of the chamber 61 into the spring chamber 50. In the opening motion of the injection valve member 34, the peg 60 is moved along with it and enters farther into the spring chamber 50. As a result, the region 60*b* of the peg 60 having the larger cross section enters the bore 59, so that now only a smaller gap remains between the peg 60 and the bore 59, thus preventing the positive displacement of fuel out of the chamber 61 into the spring chamber 50. As a result, damping of the motion of the injection valve member 34 in its opening direction is achieved.

Figure 5:
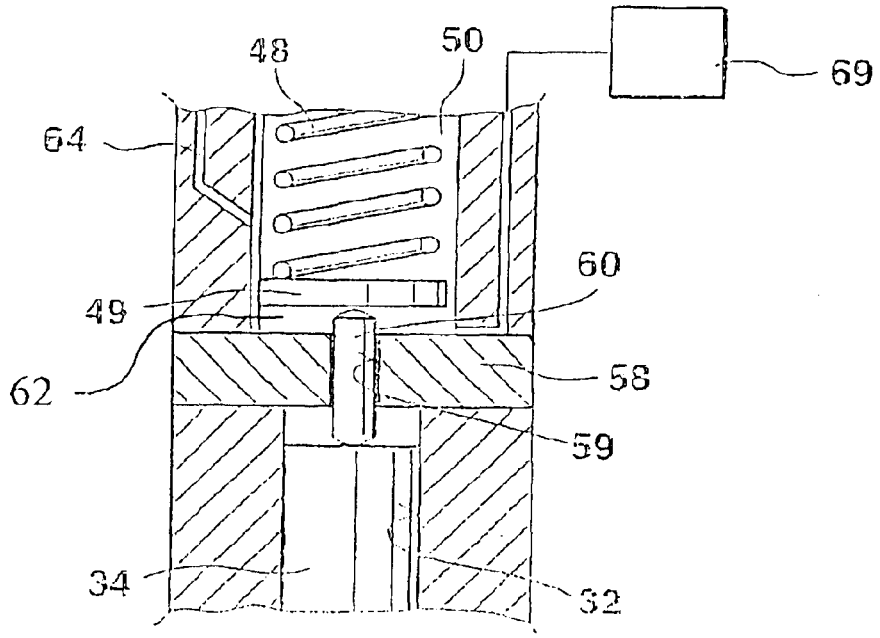

In FIG. 5, the fuel injection system is shown in a detail of a fifth exemplary embodiment. Here the peg 60 passes through the bore 59 in the partition 58 with great radial play. The spring plate 49 is disposed with slight radial play in the spring chamber 50, so that by it, toward the partition 58, a chamber 62 is disconnected from the spring chamber 50, which chamber 62 communicates with a low-pressure region 69. Now effectively the entire cross-sectional area of the spring plate 49 is acted upon by the pressure prevailing in the spring chamber 50.

Figure 6:
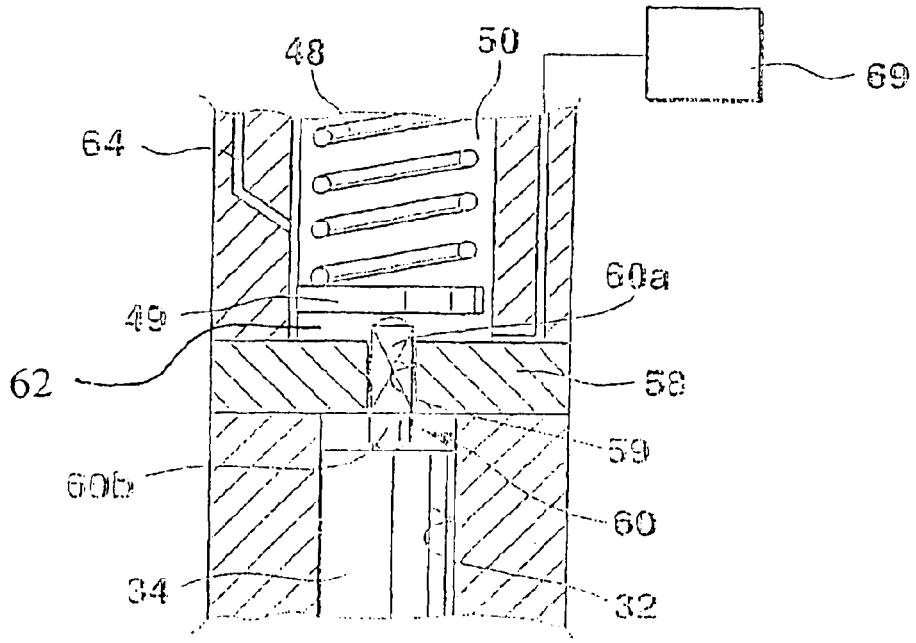

In FIG. 6, the fuel injection system is shown in a detail of a sixth exemplary embodiment. The peg 60 passes with slight radial play through the bore 59 in the partition 58 and, as in the fourth exemplary embodiment, has the regions 60*a, b* of different-sized cross sections. The spring plate 49 is disposed with slight radial play in the spring chamber 50, so that by it, toward the partition 58, a chamber 62 is disconnected from the spring chamber 50, which communicates with a low-pressure region 69. Now effectively the entire cross-sectional area of the spring plate 49 is acted upon by the pressure prevailing in the spring chamber 50. The damping function of the peg 60 with its regions 60*a, b* is the same as has been described for the fourth exemplary embodiment.

Various exemplary embodiments will now be described for how the pressure in the spring chamber 50 can be varied. All the exemplary embodiments described below can be combined with one of the first through sixth exemplary embodiments described above. In the first exemplary embodiment, shown in FIG. 1, a conduit 64 that discharges into the spring chamber 50 is embodied in the valve body 30 and/or in the pump body 14. Via the conduit 64, the spring chamber 50 communicates with an external pressure source 66, which can for instance be a pressure reservoir, or a pressure generator in the form of a pump. The communication of the spring chamber 50 with the pressure source 66 is controlled by a final control element 67, which is for instance an electrically controlled valve and which can be embodied as a magnet valve and is triggered by the control unit 56. In the first exemplary embodiment shown, the valve 67 is embodied as a 2/2-way valve, by which in a first switching position the spring chamber 50 is made to communicate with the pressure source 66 and by which in a second switching position the spring chamber 50 is disconnected from the pressure source 66. At least one throttle restriction 68 can be provided in the communication of the spring chamber 50 with the pressure source 66. When the spring chamber 50 communicates with the pressure source 66, an elevated pressure prevails in it, and in accordance with one of the exemplary embodiments described above, this pressure acts on the injection valve member 34 and generates an additional force, reinforcing the force of the closing spring 48, on the injection valve member 34 in its closing direction toward the valve seat 40.

Figure 7:
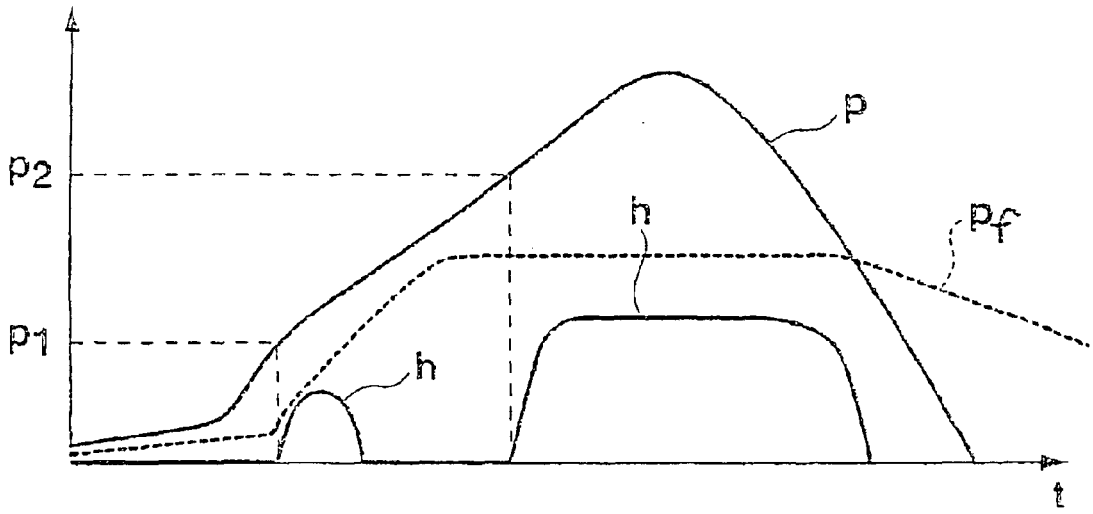
FIG. 7 shows the course of the pressure in a fuel injection valve embodying the invention and a motion of its injection valve member.

In FIG. 7, the course of the pressure p, generated in its reciprocating motion in the pumping stroke in the pump work chamber as well as in the pressure chamber 44, the pressure $p_f$ set in the spring chamber 50, and the reciprocating motion h of the injection valve member 34 of the fuel injection valve 12 is plotted over time during one injection cycle. When the fuel injection is to begin, the valve 54 is closed by the control unit 56, and the valve 67 is likewise closed. Thus a low pressure prevails in the spring chamber 50, and essentially only the force of the closing spring 48 acts on the injection valve member 34. When the pressure prevailing in the pressure chamber 44, via the pressure shoulder 46, generates a force on the injection valve member 34 in its opening direction away from the valve seat 40, which force is greater than the force of the closing spring 48, then the fuel injection valve 12 opens. The injection valve member 34 lifts with its sealing face 38 from the valve seat 40 and opens the injection openings 36, through which fuel is injected. The fuel preinjection takes place at relatively low pressure and in a lesser quantity than a main fuel injection. The pressure in the pressure chamber 44 at which the fuel injection valve 12 opens is called the opening pressure. For terminating the preinjection of fuel, the valve 67 is opened by the control unit 56, so that the spring chamber 50 communicates with the pressure source 66, and in it, an elevated pressure is set, corresponding to the pressure furnished by the pressure source 66. The closing force acting on the injection valve member 34 is thus increased, so that the fuel injection valve 12 closes again because the injection valve member 34 comes to rest with its sealing face 38 on the valve seat 40. After that, the pressure in the pressure chamber 44 rises in accordance with the profile of the cam 22 that drives the pump piston 18, that an increasing pressure force in the opening direction acts on the injection valve member 34. When the opening force generated by the pressure prevailing in the pressure chamber 44 on the injection valve member 34 exceeds the closing force, which is a total of the force of the closing spring 48 and the pressure force generated by the pressure in the spring chamber 50, the fuel injection valve 12 opens again. The main injection that then ensues takes place at a higher pressure than the preinjection and for a longer length of time. The opening pressure P2 of the fuel injection valve 12 in the main injection is thus higher than the opening pressure $p_1$ in the preinjection. Upon termination of the main injection, the valve 54 is opened, so that the pressure chamber 44 is relieved. The valve 67 is closed as well, so that the spring chamber 50 is likewise relieved. In an ensuing injection cycle, a low pressure again prevails then in the spring chamber 50, so that for the preinjection, the low opening pressure $p_1$ is available at the fuel injection valve.

Figure 8:
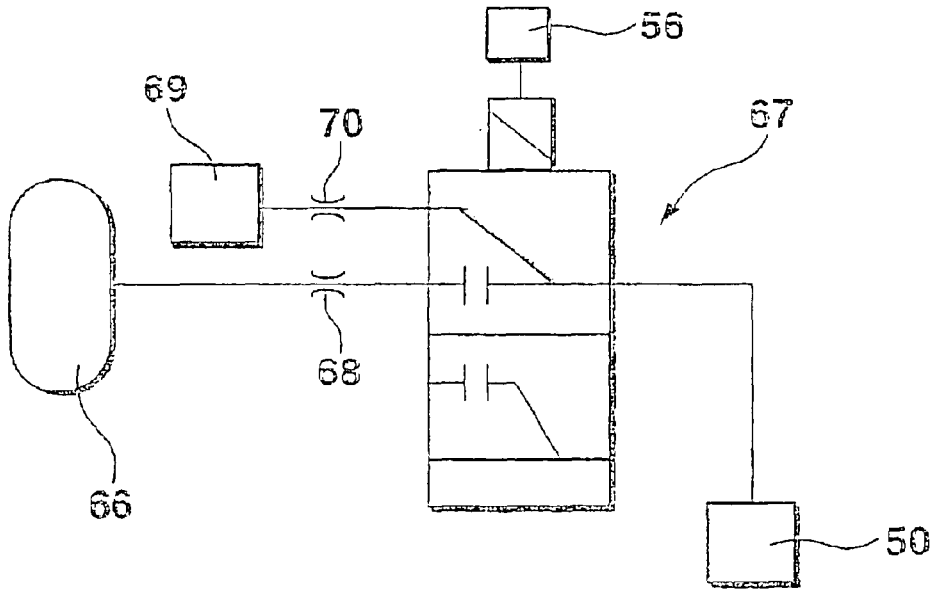
FIGS. 8–12 are schematic views of the fuel injection system in different embodiments.

In FIG. 8, the fuel injection system is shown in simplified form in a seventh exemplary embodiment, in which compared to the first exemplary embodiment the embodiment of the final control element 67 is modified. The final control element 67 is embodied as a 3/2-way valve, which has three connections and two switching positions and is triggered by the control unit. In a first switching position of the valve 67, this valve causes the spring chamber 50 to communicate with the pressure source 66 and disconnects it from a low-pressure region 69, and in a second switching position, the spring chamber 50 is disconnected from the pressure source 66 and communicates with the low-pressure region 69. A relief of the spring chamber 50 is thus likewise controlled by the valve 67. At least one throttle restriction 70 may be provided in the communication of the spring chamber 50 with the low-pressure region 69.

Figure 9:
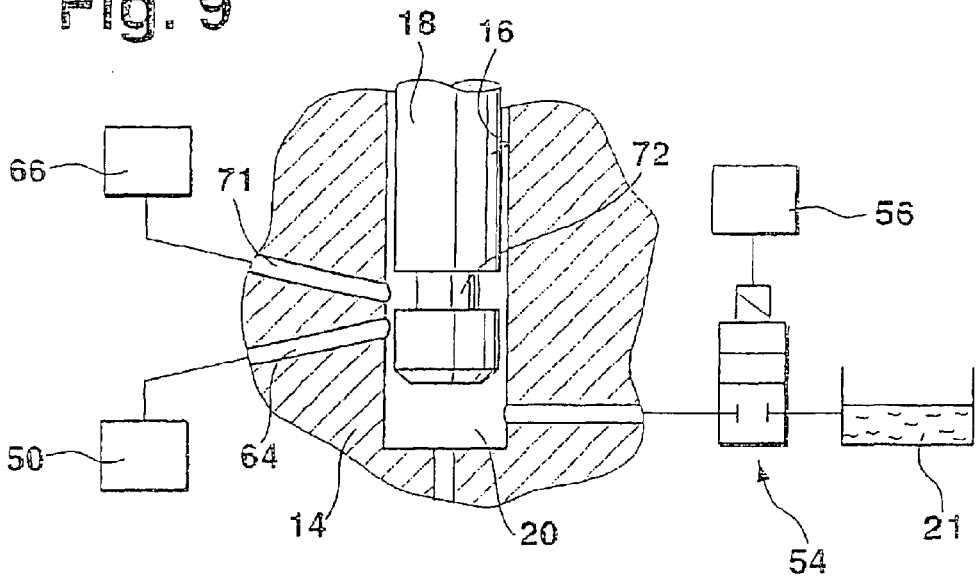

In FIG. 9, the fuel injection system is shown in simplified form in an eighth exemplary embodiment. Here the pump piston 18 acts as the final control element by which the communication of the spring chamber 50 with the pressure source 66 is controlled. Both a conduit 71 leading to the pressure source 66 and the conduit 64, spaced axially apart from that conduit, leading to the spring chamber 50 discharge into the cylinder bore 16. The pump piston 18 has a plunge cut 72 of reduced cross section that extends over a predetermined width in the axial direction. At the onset of the pumping stroke of the pump piston 18 inward into the cylinder bore 16, the pump piston is located with its full cross section in the region of the orifice of the conduit 71, so that this conduit is closed, and the spring chamber 50 is disconnected from the pressure source 66. When the pump piston 18 in its pumping stroke moves farther into the cylinder bore 16, its plunge cut 72 comes to overlap the orifice of the conduit 71, so that the conduit 64 and thus the spring chamber 50 communicate with the pressure source 66 via the plunge cut 72. At the onset of the pumping stroke of the pump piston 18, a low pressure thus prevails in the spring chamber 50, and so the low opening pressure for the preinjection is achieved, and as the pumping stroke of the pump piston 18 continues, the pressure in the spring chamber 50 is raised, so that the higher opening pressure for the main injection is reached.

Figure 10:
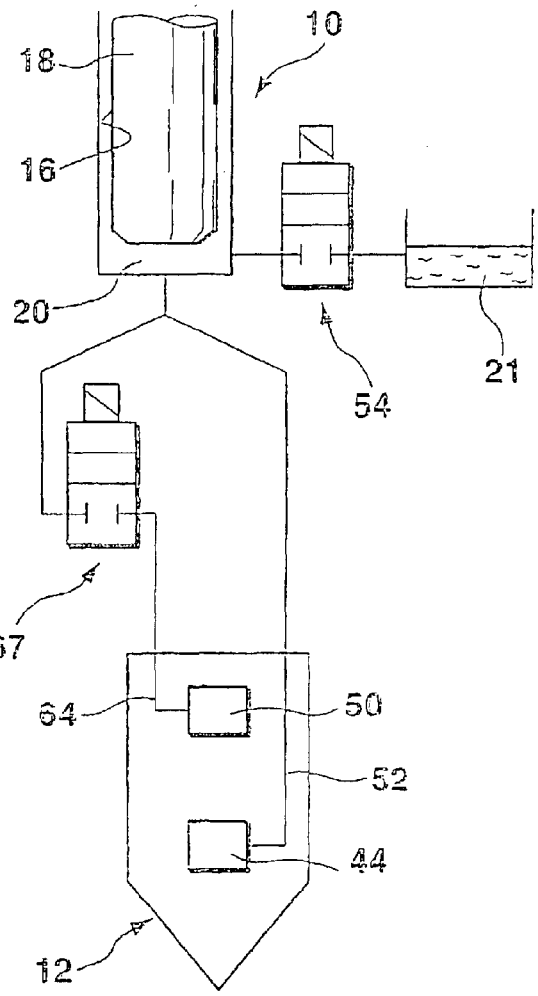

In FIG. 10, the fuel injection system is shown in simplified form in a ninth exemplary embodiment, in which unlike the exemplary embodiments described above there is no external pressure source; instead, the pump work chamber 20 is used as a pressure source for increasing the pressure in the spring chamber 50. The spring chamber 50 has a communication with the pump work chamber 20 that is controlled by a final control element 67. In the exemplary embodiment shown in FIG. 10, the final control element is embodied as a 2/2-way valve 67, by which the spring chamber 50 communicates with the pump work chamber 20 in a first switching position and is disconnected from the pump work chamber 20 in a second switching position. Alternatively, the final control element 67 can be embodied as in the eighth exemplary embodiment as a 3/2-way valve, by which in a first switching position the spring chamber 50 communicates with the pump work chamber 20 and is disconnected from a low-pressure region 69, and in a second switching position the spring chamber 50 is disconnected from the pump work chamber and communicates with the low-pressure region 69.

Figure 11:
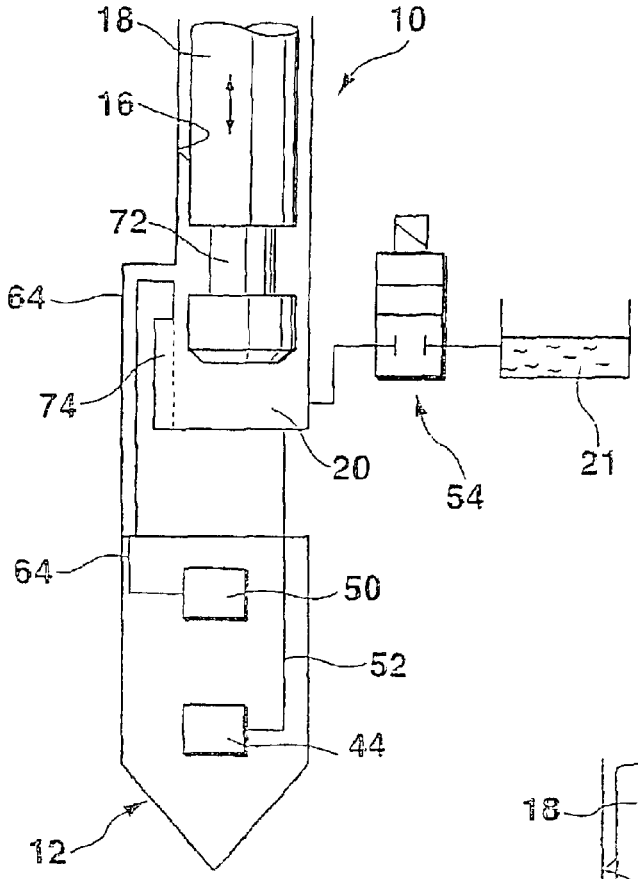

In FIG. 11, the fuel injection system is shown in simplified form in a tenth exemplary embodiment, in which once again the pump work chamber 20 serves as a pressure source for the spring chamber 50. The communication of the spring chamber 50 with the pump work chamber 20 is controlled by the pump piston 18 acting as a final control element. From the circumference of the cylinder bore 16, a conduit 64 leads to the spring chamber 50. The pump piston 18 has a plunge cut 72 of reduced cross section that extends over a predetermined width in the axial direction. The cylinder bore 16, in its inner end region over at least part of its circumference, has a radial enlargement 74, for instance in the form of a groove. At the onset of the pumping stroke of the pump piston 18 into the cylinder bore 16, the pump piston is located with its full cross section in the region between the orifice of the conduit 64 and the enlargement 74 of the cylinder bore 16, so that the conduit 64 and thus the spring chamber 50 are disconnected from the pump work chamber 20. When the pump piston 18 in its pumping stroke moves onward into the cylinder bore 16, its plunge cut 72 comes to coincide with the enlargement 74 of the cylinder bore 16, so that the conduit 64 and thus the spring chamber 50 communicate with the pump work chamber 20 via the plunge cut 72. Thus at the onset of the pumping stroke of the pump piston 18, a low pressure prevails in the spring chamber 50, so that the low opening pressure for the preinjection is reached, and as the pumping stroke of the pump piston 18 continues, the pressure in the spring chamber 50 is raised, so that the higher opening pressure for the main injection is reached.

Figure 12:
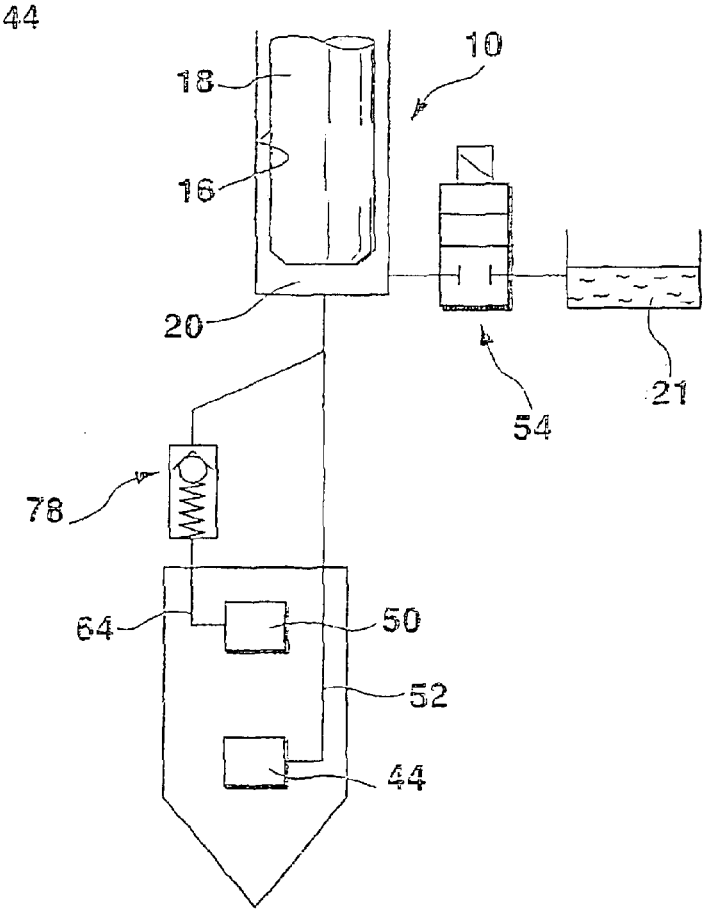

In FIG. 12, the fuel injection system is shown in simplified form in an eleventh exemplary embodiment, in which once again the pump work chamber 20 acts as a pressure source for the spring chamber 50. The spring chamber 50 has a communication with the pump work chamber 20, in which as a final control element a pressure valve 78 is disposed that opens toward the spring chamber 50. When the pressure in the pump work chamber 20 is less than the opening pressure of the pressure valve 78, the pressure valve is closed and the spring chamber 50 is disconnected from the pump work chamber 20. The spring chamber 50 is then relieved to a low-pressure region. When the pressure of the pump work chamber 20 exceeds the opening pressure of the pressure valve 78, the pressure valve opens, and the spring chamber 50 communicates with the pump work chamber 20. The opening pressure of the pressure valve 78 is set such that this valve closes when the pumping stroke is short and the pressure in the pump work chamber 20 is thus low, so that a low pressure prevails in the spring chamber 50, and a low opening pressure of the fuel injection valve 12 for the preinjection is reached. As the pumping stroke lengthens and the pressure in the pump work chamber 20 thus rises, the pressure valve 78 opens, so that the spring chamber 50 communicates with the pump work chamber 20, and a higher opening pressure of the fuel injection valve 12 for the main injection is reached.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system for an internal combustion engine, having a fuel injection valve (12), which has an injection valve member (34), by which valve member at least one injection opening (36) is controlled, and the injection valve member (34) is acted upon by the pressure prevailing in a pressure chamber (44) of the fuel injection valve (12) and is movable by this pressure, counter to the force of a closing spring (48) disposed in a spring chamber (50) of the fuel injection valve (12), in an opening direction to open the at least one injection opening (36), and fuel is delivered under high pressure to the pressure chamber (44) by a high-pressure fuel pump (10) for a fuel injection, the improvement wherein the injection valve member (34) is urged in the closing direction at least indirectly by the pressure prevailing in a spring chamber (50) of the fuel injection valve (12); and wherein the pressure in the spring chamber (50) is variable, further comprising a spring plate (49), which rests on the closing spring (48) in the spring chamber (50), the injection valve member (34) being braced on said spring plate via a peg (60) of smaller cross section than the valve member, which peg passes through an opening (59) in a partition (58) of the spring chamber (50).

2. The fuel injection system of claim 1 wherein the spring plate (49) is disposed with great radial play in the spring chamber (50), and wherein the peg (60) passes with great radial play through the opening (59) in the partition (58), so that effectively the cross-sectional area (35) oriented toward the spring chamber (50) is acted upon by the pressure prevailing in the spring chamber (50).

3. The fuel injection system of claim 1 wherein the spring plate (49) is disposed with great radial play in the spring chamber (50), and wherein the peg (60) passes with slight radial play through the opening (59) in the partition (58), so that effectively the cross-sectional area of the peg (60) is acted upon by the pressure prevailing in the spring chamber (50).

4. The fuel injection system of claim 1 wherein the spring plate (49) is disposed with slight radial play in the spring chamber (50), so that effectively the cross-sectional area of the spring plate (49) is acted upon by the pressure prevailing in the spring chamber (50).

5. The fuel injection system of claim 3 wherein the peg (60) comprises regions **(60*a, b*) of different-sized cross section over its length, and in a closing position of the injection valve member (34) the peg (60) passes with a region (61) of smaller cross section through the opening (59) in the partition (58), and upon a motion of the injection valve member (34) in the opening direction, the peg dips with a region (60*b*) or larger cross section into the opening (59), as a result of which the motion of the injection valve member (34)** in the opening direction is damped.

6. The fuel injection system of claim 4 wherein the peg (60) comprises regions **(60*a, b*) of different-sized cross section over its length, and in a closing position of the injection valve member (34) the peg (60) passes with a region (61) of smaller cross section through the opening (59) in the partition (58), and upon a motion of the injection valve member (34) in the opening direction, the peg dips with a region (60***b*) or larger cross section into the opening (59), as a result of which the motion of the injection valve member (34) in the opening direction is damped.

7. The fuel injection system of claim 1 wherein during one fuel injection cycle, at the onset, for a preinjection of fuel in the spring chamber (50), a low pressure is set; and wherein for an ensuing main injection of fuel in the spring chamber (50), an elevated pressure is set.

8. The fuel injection system of claim 1 further comprising a pressure source (66; 20) communicating with the spring chamber (50), and a valve (67) controlling the communication between the spring chamber (50) and the pressure source (66; 20).

9. The fuel injection system of claim 8 wherein the valve (67) is an electrically controlled valve.

10. The fuel injection system of claim 9 wherein the valve (67) is a 2/2-way valve, by which in a first switching position the spring chamber (50) is made to communicate with the pressure source (66; 20), and by which in a second switching position the spring chamber (50) is disconnected from the pressure source (66; 20).

11. The fuel injection system of claim 9 wherein valve (67) is a 3/2-way valve, by which in a first switching position the spring chamber (50) is made to communicate with the pressure source (66; 20), and is disconnected from a low-pressure region (69) and by which in a second switching position the spring chamber (50) is disconnected from the pressure source (66; 20) and is made to communicate with the low-pressure region (69).

12. The fuel injection system of claim 1 further comprising a pressure source (66; 20) communicating with the spring chamber (50), the high-pressure fuel pump (10) having a pump piston (18), which is driven in a reciprocating motion; and wherein by means of the pump piston (18), as a function of its pumping stroke, the communication of the spring chamber (50) with the pressure source (66; 20) is controlled.

13. The fuel injection system of claim 8 wherein the high-pressure fuel pump (10) has a pump piston (18), which is driven in a reciprocating motion and defines a pump work chamber (20); and wherein the pump work chamber (20) serves as the pressure source for the spring chamber (50).

14. The fuel injection system of claim 8 further comprising at least one throttle restriction (68) in the communication of the spring chamber (50) with the pressure source (66; 20).

15. The fuel injection system of claim 1 further comprising a low-pressure region (69) communicating with the spring chamber (50), and at least one throttle restriction (70) in the communication with the low-pressure region (69).

16. The fuel injection system of claim 1 further comprising a pressure source (66; 20) communicating with the spring chamber (50), a pressure valve (78) in the communication between the pressure source (66; 20) and the spring chamber (50), the pressure valve (78) opening toward the spring chamber (50), which pressure valve, when a predetermined pressure is exceeded, opens the communication of the spring chamber (50) with the pressure source (66; 20).

17. The fuel injection system of claim 1 wherein the fuel injection system comprises one fuel injection valve (12) and one high-pressure fuel pump (10), which form a common structural unit, for each cylinder of the engine.

18. In a fuel injection system for an internal combustion engine, having a fuel injection valve (12), which has an injection valve member (34), by which valve member at least one injection opening (36) is controlled, and the injection valve member (34) is acted upon by the pressure prevailing in a pressure chamber (44) of the fuel injection valve (12) and is movable by this pressure, counter to the force of a closing spring (48) disposed in a spring chamber (50) of the fuel injection valve (12), in an opening direction to open the at least one injection opening (36), and fuel is delivered under high pressure to the pressure chamber (44) by a high-pressure fuel pump (10) for a fuel injection, the improvement wherein the injection valve member (34) is urged in the closing direction at least indirectly by the pressure prevailing in a spring chamber (50) of the fuel injection valve (12); and wherein the pressure in the spring chamber (50) is variable, further comprising a chamber (62) separated from the spring chamber (50) toward the partition (58), said chamber (62) communicating with a low-pressure region (69).

19. The fuel injection system of claim 18 further comprising a spring plate (49), which rests on the closing spring (48) in the spring chamber (50), the injection valve member (34) being braced on said spring plate via a peg (60) of smaller cross section than the valve member, which peg passes through an opening (59) in a partition (58) of the spring chamber (50).

20. The fuel injection system of claim 18 wherein the peg (60) comprises regions (60*a, b*) of different-sized cross section over its length, and in a closing position of the injection valve member (34) the peg (60) passes with a region (61) of smaller cross section through the opening (59) in the partition (58), and upon a motion of the injection valve member (34) in the opening direction, the peg dips with a region (60*b*) or larger cross section into the opening (59), as a result of which the motion of the injection valve member (34) in the opening direction is damped.

21. In a fuel injection system for an internal combustion engine, having a fuel injection valve (12), which has an injection valve member (34), by which valve member at least one injection opening (36) is controlled, and the injection valve member (34) is acted upon by the pressure prevailing in a pressure chamber (44) of the fuel injection valve (12) and is movable by this pressure, counter to the force of a closing spring (48) disposed in a spring chamber (50) of the fuel injection valve (12), in an opening direction to open the at least one injection opening (36), and fuel is delivered under high pressure to the pressure chamber (44) by a high-pressure fuel pump (10) for a fuel injection, the improvement wherein the injection valve member (34) is urged in the closing direction at least indirectly by the pressure prevailing in a spring chamber (50) of the fuel injection valve (12); and wherein the pressure in the spring chamber (50) is variable, further comprising a pressure source (66; 20) communicating with the spring chamber (50), the high-pressure fuel pump (10) having a pump piston (18), which is driven in a reciprocating motion; and wherein by means of the pump piston (18), as a function of its pumping stroke, the communication of the spring chamber (50) with the pressure source (66; 20) is controlled, and wherein the spring chamber (50), at a short pumping stroke of the pump piston (18), is disconnected from the pressure source (66; 20), and at a longer pumping stroke of the pump piston (18) is made to communicate with the pressure source (66; 20).

* * * * *